United States Patent [19]

Stumpf

[11] 3,951,398

[45] Apr. 20, 1976

[54] FABRIC LAYERING MACHINE

[76] Inventor: Günter Stumpf, Hohenweg 13, 7421 Mehrstetten (Kr. Munsingen), Germany

[22] Filed: Mar. 28, 1974

[21] Appl. No.: 455,731

[30] Foreign Application Priority Data

Mar. 30, 1973 Germany ..... 7312181[U]

[52] U.S. Cl. ..... 270/31

[51] Int. Cl.[2] ..... B65H 29/46

[58] Field of Search ..... 270/30–31

[56] References Cited

UNITED STATES PATENTS

| | | | |
|---|---|---|---|
| 2,263,555 | 11/1941 | Gilbert | 270/31 |
| 2,921,786 | 1/1960 | Deichmann | 270/31 |
| 3,506,254 | 4/1970 | Stumpf | 270/31 |
| 3,622,146 | 11/1971 | Adachi | 270/31 |
| 3,779,541 | 12/1973 | Stumpf | 270/31 |

*Primary Examiner*—Edgar S. Burr
*Assistant Examiner*—A. Heinz
*Attorney, Agent, or Firm*—Haseltine, Lake & Waters

[57] ABSTRACT

A fabric layering machine for movement along a layering table, comprising a frame, mounting means carried by said frame for mounting a supply of fabric, first and second power rollers carried by the frame, transfer means operable to move one of the power rollers between a first position in which that one of the power rollers is in close proximity to the other of the power rollers so as to form a nip therebetween, and a second position in which one of the power rollers is spaced apart from the other of the power rollers, power means operable to rotate said power rollers, when the first one of the power rollers is in the first position, in opposite senses relative to each other so as to pull a web of fabric through the nip between the power rollers from the supply of fabric, and a deflecting roller carried by said frame and disposed before the first roller with respect to the path of a web of fabric from the supply of fabric for causing the web to contact the first power roller over an arc of contact.

8 Claims, 3 Drawing Figures

FABRIC LAYERING MACHINE

This invention relates to a fabric layering machine for movement along a layering table.

German Patent Specification No. 2,129,416 discloses a fabric layering machine for layering a double-layer web of fabric, i.e. a web which has been folded about its longitudinal centre line, and having a pair of draw-off rollers arranged to draw-off the web from a roll of double-layer fabric supported on a support device of the machine.

In German Gebrauchsmuster No. 1,977,821 there is disclosed a layering machine for layering single-layer fabric. This machine may be fitted with a layering head, for layering in zig-zag configuration, or a web-severing device, the two being readily interchangeable.

Heretobefore, to undertake layering of webs of single-layer fabric and webs of double-layer fabric, it has been necessary to have available two layering machines, such as for example those just mentioned.

The present invention provides a fabric layering machine for movement along a layering table, comprising a frame, mounting means carried by said frame for mounting a supply of fabric, first and second power rollers carried by said frame, transfer means operable to move one of said power rollers between a first position in which said one of said power rollers is in close proximity to the other of said power rollers, so that there is a nip provided therebetween, and a second position in which said one of said power rollers is spaced apart from said other of said power rollers, power means operable to rotate said power rollers, when said one of said power rollers is in said first position, in opposite senses relative to each other so as to pull a web of fabric through the nip of said power rollers from said supply of fabric, and a deflecting roller carried by said frame and disposed before the first roller with respect to the path of a web of fabric from said supply of fabric for causing said web to contact said first power roller over an arc of contact.

By means of the invention it is possible to carry out the layering of single-layer fabric and double-layer fabric with one and the same fabric layering machine.

In order that the invention may be clearly understood and readily carried into effect, reference will now be made, by way of example, to the accompanying drawings, in which.

Figure 1:
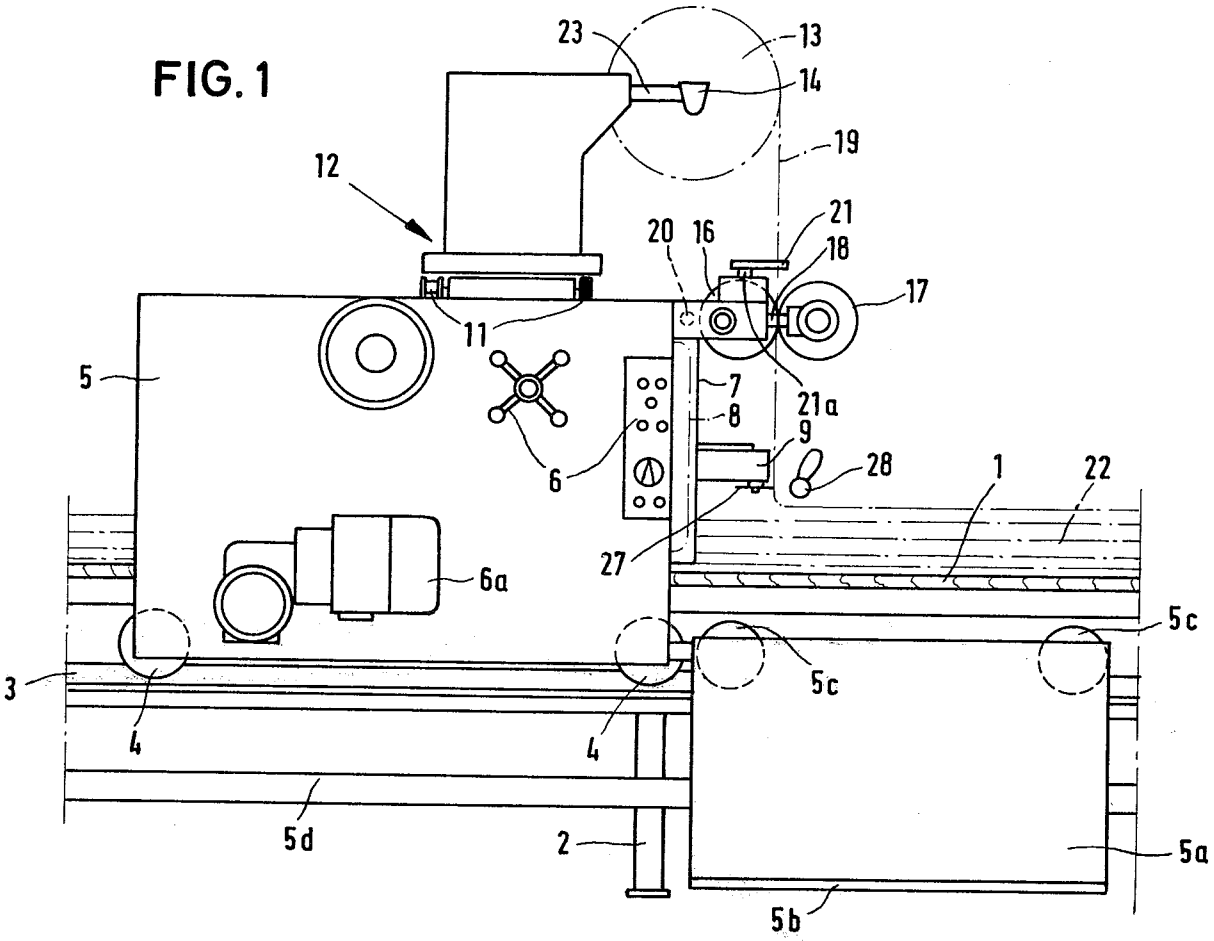
FIG. 1 shows a side elevation of a fabric layering machine and parts of a layering table.

Referring to the drawings, a layering table has a table top 1 supported by legs 2 (only one of which is shown). Secured to the legs 2, on each longitudinal side of the layering table, are travel rails 3 on which a fabric layering machine is arranged to run by way of wheels 4 secured to a frame 5 of the machine. On the frame 5 there is provided an operating console 6. A drive motor for driving the layering machine along the layering table is designated 6*a*. Releasably coupled to the frame 5 is a follower carriage 5*a* having an operating platform 5*b*. The carriage 5*a* is provided with wheels 5*c* which run on the rails 3. The follower carriage 5*a* is also supported by at least one support wheel (not shown) having a vertical axis and running on a flat rail 5*d* of the layering table.

At the right hand end of the frame 5 (as viewing the drawings) there are secured two guide rails 7 extending vertically downwardly approximately as far as the table top 1 and serving for guiding a transverse web-severing device 9 (see FIGS. 1 and 2) releasably arranged on an endless chain 8, or a layering head 10 (see FIG. 3) having shovels (not shown). Arranged releasably at an upper part of the frame 5 is a mounting carriage 12 displaceable, by way of wheels 11, transversely of the travel direction of the layering machine and carrying horizontally extending support arms 23 for supporting a supply of fabric in the form of a roll 13. Secured to the support arms 23 are bearing members 14 for receiving the ends of a pivot shaft 15 of the roll 13 of fabric.

At the right-hand side of the frame 5 there is furthermore arranged a pair of power rollers in the form of draw-off rollers 16, 17 which are disposed with their axes in a common horizontal plane. Driving of the draw-off rollers 16, 17 is effected in a manner known from German Patent Specification No. 2,129,416. The spacing of the draw-off rollers 16, 17 is variable with the aid of transfer means including bars 18 which are displaceable in controlled manner as described in German Patent Specification No. 2,129,416. The left hand draw-off roller 16 has connected upstream of it a deflecting roller 20 for guiding the fabric web 19 to be laid up over the draw-off roller 16 (see FIGS. 2 and 3). The axis of the deflecting roller 20 is contained in the same horizontal plane as are the axes of the draw-off rollers 16, 17.

The frame 5 also carries a lateral edge-sensing device 21 for sensing an edge of the fabric web 19 to be laid-up and which, in the event of transverse shift of the fabric web 19, provides control signals, in a manner known from German Patent Specification No. 2,129,416, to a drive of a positioning means (not shown) for transverse adjustment of the mounting carriage 12 so as to achieve a precise layering one above the other of the edges of web lengths 22 laid-up on the table top 1.

The fabric layering machine when arranged as shown in FIG. 1 serves for the layering of double-layer fabric. By operation of the transfer means it is always possible to achieve vertical web drop into the nip between the two draw-off rollers 16, 17, and so avoid bending or creasing of the fold edge of the web. Adjustment of the arms 23 is automatically controlled by a plane-sensing device (not shown) which senses deviation of the dropping plane of the web, occurring owing to the decrease in the diameter of the fabric roll 13, from the vertical plane containing the nip between the rollers 16, 17 and provides control signals to an adjustment means (not shown). The plane-sensing device is combined to afford a constructional unit with the edge-sensing device 21.

Figure 2:
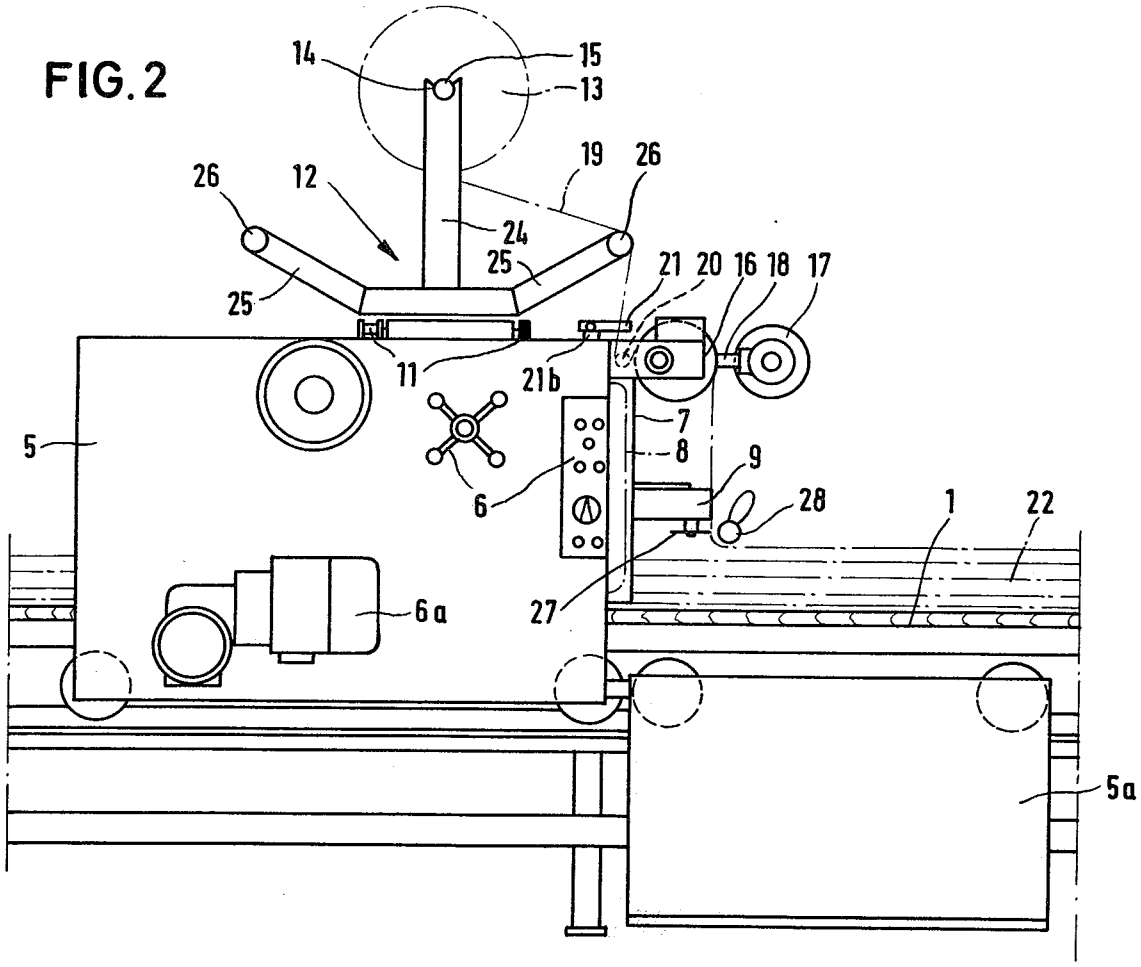
FIG. 2 shows a view similar to that of FIG. 1 but with the fabric layering machine being provided with a different support device.
Figure 3:
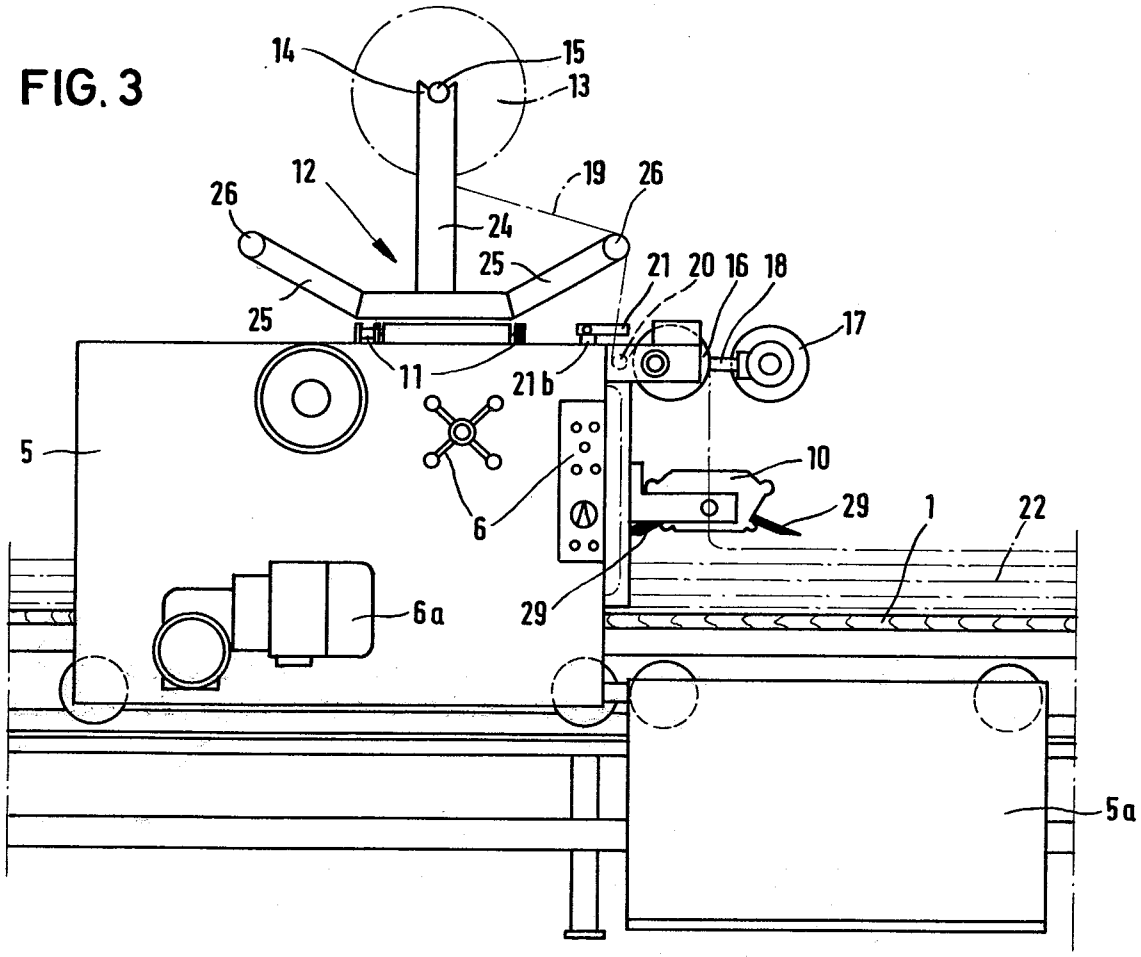
FIG. 3 shows a view similar to that of FIG. 2 but with a web-severing device of the fabric layering machine having been replaced by a layering head.

If after completion of the layering of a double-layer fabric, it is desired, using the same fabric layering machine, to lay up single-layer fabric, then it is merely necessary to replace the mounting carriage 12 shown in FIG. 1 by a mounting carriage 12 as shown in FIGS. 2 and 3, to displace the draw-off roller 17 from the draw-off roller 16, and to lead the fabric web 19 of single-layer fabric under the deflecting roller 20 and then over the draw-off roller 16 now acting as a delivery roller, the web 19 falling vertically downwardly from the roller 16 without the draw-off roller 17 contacting the web 19. The web 19 contacts the roller 16 over an arc of contact of about 180°. The edge-sensing device 21 is readily moved out of a receiving device 21*a* (see FIG. 1) and arranged in a receiving device 21*b* (see FIGS. 2 and 3). The machine can as speedily be readapted for layering double-thickness fabric.

The mounting carriage shown in FIGS. 2 and 3 differs from the mounting carriage shown in FIG. 1 in that in the former there is provided a pair of vertical carrier supports 24 which are arranged centrally of the mounting carriage 12 and are provided at their upper ends with bearing recesses 14 for receiving the ends of a pivot shaft 15 of a roll of fabric. Additionally, the mounting carriage of FIGS. 2 and 3 has upwardly inclined cantilever arms 25 at the ends of which guide rollers 26 are mounted. From the right-hand side guide roller 26 the fabric web 19 to be laid-up travels to the deflecting roll 20. The spacing of the carrier supports 24 is approximately twice that of the spacing of the support arms 23 since a double-layer web is half the width of the single-layer web from which it is formed.

Both the web-severing device 9 shown in FIGS. 1 and 2 and also the layering head 10 shown in FIG. 3 are arranged, in the manner known from German Gebrauchsmuster No. 1,977,821, to be releasably connected to the endless chain 8. The chain 8 is adapted to rotate in order that the web-severing device 9 or the layering head 10 may be vertically adjustable in controlled manner as a function of the height of the uppermost web length of the web lengths 22 disposed on the table top 1. After disengaging the web-severing device 9, the layering head 10 can be engaged within a short period of time, so that rapid conversion from a fabric layering machine for layering in the run direction, i.e. with transverse severing after laying-up each layer, to a layering machine for layering in zig-zag configuration, i.e. without transverse cutting, is possible.

Thus the fabric web 19 travels from the draw-off rollers 16, 17, or from the left-hand draw-off roller 16, operating as delivery roll, either into the cutting zone of a power driven circular knife 27 of the web-severing device 9, or between the shovels of the layering head 10.

Disposed in the cutting zone of the circular knife 27 is a cylindrical member 28 extending transversely of the direction of movement of the layering machine and having a longitudinally extending cutting-slot affording counter-blade guiding means.

The two shovels of the layering head 10 are mounted, in the manner known from German Gebrauchsmuster No. 1,977,821, to be pivotal about horizontal axes in the layering head 10. Run-up cams 29 (shown in FIG. 3) produce the effect that in each particular instance one of the two shovels pushes the folded-back fabric web engaging about its front edge under one of two clamping devices (not shown) provided at the two ends of the table top 1.

What we claim is:

1. A fabric layering machine for movement along a layering table, comprising a frame, mounting means carried by said frame for mounting a supply of fabric, first and second power rollers carried by said frame, transfer means operable to move one of said power rollers between a first position in which said one of said power rollers is in close proximity to the other of said power rollers so as to form a nip therebetween, and a second position in which said one of said power rollers is spaced apart from said other of said power rollers, power means operable to rotate said power rollers, when said one of said power rollers is in said first position, in opposite senses relative to each other so as to pull a web of fabric through the nip between said power rollers from said supply of fabric, and a deflecting roller carried by said frame and disposed before the first roller with respect to the movement of said web of fabric from said supply of fabric for causing said web to contact said first power roller over an arc of contact, said deflecting roller being positioned at a side of said first power roller remote from the second power roller, said deflecting roller, and said first and second power rollers having axes located in a common horizontal plane; said transfer means being operable to move said one of said power rollers between said first and second positions along a path such that the axis of one of said power rollers remains in a single plane containing the axis of the other of said power rollers, and the axis of said deflecting roller is also contained in said plane.

2. A fabric layering machine as claimed in claim 1, in which said mounting means is detachably fastened to said frame.

3. A fabric layering machine as claimed in claim 1, further comprising a web-severing device mounted releasably on said frame and operable to sever said web; said power rollers subsequent to said web passing between the latter.

4. A fabric layering machine as claimed in claim 1 further comprising a layering head mounted releasably on said frame and operable to lay said web in zig-zag configuration.

5. A fabric layering machine for movement along a layering table, comprising a frame, mounting means carried by said frame for mounting a supply of fabric, first and second power rollers carried by said frame, transfer means operable to move one of said power rollers between a first position in which said one of said power rollers is in close proximity to the other of said power rollers so as to form a nip therebetween, and a second position in which said one of said power rollers is spaced apart from said other of said power rollers, power means operable to rotate said power rollers, when said one of said power rollers is in said first position, in opposite senses relative to each other so as to pull a web of fabric through the nip between said power rollers from said supply of fabric, and a deflecting roller carried by said frame and disposed before the first roller with respect to the movement of said web of fabric from said supply of fabric for causing said web to contact said first power roller over an arc of contact, said deflecting roller being positioned at a side of said first power roller remote from the second power roller, said deflecting roller, and said first and second power rollers having axes located in a common horizontal plane; said mounting means comprising support means for supporting a roll of fabric forming said supply of fabric, and adjustment means operable to adjust the position of the axis of said roll of fabric relative to said nip in a direction parallel to the movement of the machine on said table.

6. A fabric layering machine as claimed in claim 5, further comprising a plane-sensing device operable to sense the plane of said web of fabric proximate said power rollers and to provide control signals to said adjustment means.

7. A fabric layering machine for movement along a layering table, comprising a frame, mounting means carried by said frame for mounting a supply of fabric, first and second power rollers carried by said frame, transfer means operable to move one of said power rollers between a first position in which said one of said power rollers is in close proximity to the other of said power rollers so as to form a nip therebetween, and a second position in which said one of said power rollers is spaced apart from said other of said power rollers, power means operable to rotate said power rollers, when said one of said power rollers is in said first position, in opposite senses relative to each other so as to pull a web of fabric through the nip between said power rollers from said supply of fabric, and a deflecting roller carried by said frame and disposed before the first roller with respect to the movement of said web of fabric from said supply of fabric for causing said web to contact said first power roller over an arc of contact, said deflecting roller being positioned at a side of said first power roller remote from the second power roller, said deflecting roller, and said first and second power rollers having axes located in a common horizontal plane; said mounting means comprising positioning means operative to move said mounting means relative to said frame transversely of the movement of the machine along said table.

8. A fabric layering machine as claimed in claim 7, further comprising an edge-sensing device operable to sense an edge of said web of fabric and to provide control signals to said positioning means.

* * * * *